US009874054B2

(12) United States Patent
Mitchell et al.

(10) Patent No.: US 9,874,054 B2
(45) Date of Patent: Jan. 23, 2018

(54) ENTRYWAY WITH ARTICULATING THRESHOLD

(71) Applicant: Endura Products, Inc., Colfax, NC (US)

(72) Inventors: Mike Mitchell, Winston-Salem, NC (US); Tomasz Jaskiewicz, Oak Ridge, NJ (US)

(73) Assignee: Endura Products, Inc., Colfax, NC (US)

( * ) Notice: Subject to any disclaimer, the term of this patent is extended or adjusted under 35 U.S.C. 154(b) by 0 days.

(21) Appl. No.: 15/364,740

(22) Filed: Nov. 30, 2016

(65) Prior Publication Data

US 2017/0081908 A1 Mar. 23, 2017

Related U.S. Application Data

(63) Continuation of application No. 14/717,194, filed on May 20, 2015, now Pat. No. 9,528,314.

(51) Int. Cl.

| | |
|---|---|
| ***E06B 7/18*** | (2006.01) |
| ***E06B 1/70*** | (2006.01) |
| ***E06B 7/23*** | (2006.01) |

(52) U.S. Cl.

CPC ..... *E06B 7/18* (2013.01); *E06B 1/70* (2013.01); *E06B 7/2314* (2013.01); *E06B 7/2316* (2013.01)

(58) Field of Classification Search

None

See application file for complete search history.

(56) References Cited

U.S. PATENT DOCUMENTS

| | | | | |
|---|---|---|---|---|
| 56,046 | A | 7/1866 | Hawkins | |
| 126,014 | A | 4/1872 | Brown et al. | |
| 220,460 | A | 10/1879 | York | |
| 313,742 | A | 3/1885 | Kintner | |
| 394,864 | A | 12/1888 | Lathrop | |
| 435,658 | A * | 9/1890 | Brennaman | E06B 7/2316 49/304 |
| 500,885 | A | 7/1893 | Green et al. | |
| 582,451 | A | 5/1897 | Brannon | |
| 600,301 | A | 3/1898 | Barger | |
| 618,013 | A | 1/1899 | Roeder | |
| 1,468,958 | A | 9/1923 | Champion | |

(Continued)

FOREIGN PATENT DOCUMENTS

| | | |
|---|---|---|
| DE | 19932332 | 2/2001 |
| EP | 327840 | 1/1989 |
| GB | 411361 | 6/1934 |

OTHER PUBLICATIONS

Afco Industries, Inc., Millwork Products Catalogue (52 pgs.), pp. cover page, 6 (vinyl cap) and 9 (riser), believed available as of 2012.

(Continued)

*Primary Examiner* — Katherine Mitchell
*Assistant Examiner* — Marcus Menezes
(74) *Attorney, Agent, or Firm* — Womble Bond Dickinson (US) LLP

(57) ABSTRACT

A threshold having a threshold cap. The threshold cap has an aperture through its top wall. The threshold also includes a pin capture positioned below the threshold cap and corresponding in location to the aperture. The pin capture is positioned to receive a pin passing through the aperture.

20 Claims, 16 Drawing Sheets

(56) References Cited

U.S. PATENT DOCUMENTS 1,595,827 A 8/1926 Frisque
1,795,853 A 3/1931 Glass
1,993,506 A 10/1933 Fauner
2,108,137 A 2/1938 Oftedal et al.
2,129,381 A 9/1938 Oftedal et al.
2,202,482 A 5/1940 Dahl
2,579,875 A 12/1951 Stanko
2,663,056 A 12/1953 Hardgrave
2,696,029 A 12/1954 Neff
2,728,118 A 12/1955 Gossen
2,818,614 A * 1/1958 Lapka, Jr. ..... E06B 1/70 49/469
3,083,420 A 4/1963 Tinflow
3,114,180 A 12/1963 Riedl
3,273,287 A 9/1966 Pease, Jr.
3,374,579 A 3/1968 Neff
3,402,512 A 9/1968 Peterson
3,432,966 A 3/1969 Bordner
3,475,866 A 11/1969 Johansen
3,762,100 A 10/1973 Kempel
3,854,246 A 12/1974 McAllister
3,900,967 A 8/1975 Bursk et al.
3,962,828 A 6/1976 McAllister
3,967,412 A 7/1976 Governale
4,055,917 A 11/1977 Coller
4,073,093 A 2/1978 Ookawa et al.
4,079,550 A 3/1978 Bursk et al.
4,104,830 A 8/1978 Eagle
4,146,995 A 4/1979 Britt
4,156,325 A 5/1979 McMullen et al.
4,213,275 A 7/1980 Oehmig
4,224,766 A 9/1980 Procton
4,287,684 A 9/1981 McKann
4,310,991 A 1/1982 Seely, Jr.
4,352,258 A 10/1982 Bursk et al.
4,387,535 A 6/1983 Corbo
4,411,104 A 10/1983 St. Aubin
4,447,987 A 5/1984 Lesosky
4,447,989 A 5/1984 Malland et al.
4,513,536 A 4/1985 Giguere
4,525,953 A 7/1985 Stutzman
4,625,457 A 12/1986 Avery
4,628,639 A 12/1986 Lownsdale
4,716,683 A 1/1988 Minter
4,831,779 A 5/1989 Kehrli et al.
5,010,690 A 4/1991 Geoffrey
5,012,614 A 5/1991 Shea
5,018,307 A 5/1991 Burrous et al.
5,067,279 A 11/1991 Hagemeyer
5,136,814 A 8/1992 Headrick
5,179,804 A 1/1993 Young
5,230,181 A 7/1993 Geoffrey et al.
5,426,894 A 6/1995 Headrick
5,588,266 A 12/1996 Headrick
5,592,782 A 1/1997 Scott
5,638,641 A 6/1997 Joffe et al.
5,675,935 A 10/1997 Lin
5,706,607 A 1/1998 Frey
5,857,291 A * 1/1999 Headrick ..... E05C 1/04 292/145
5,943,825 A 8/1999 Procton et al.
6,006,375 A 12/1999 Carr
6,052,949 A 4/2000 Procton et al.
6,061,967 A 5/2000 Judda
6,125,584 A 10/2000 Sanders
6,138,413 A 10/2000 Fehr
6,216,395 B1 4/2001 Kelly
6,345,477 B1 2/2002 Kepler et al.
6,367,201 B1 4/2002 Massey
6,371,188 B1 4/2002 Baczuk et al.
6,484,446 B2 11/2002 Young
D488,243 S 4/2004 Babka et al.
6,763,639 B2 7/2004 Bennett et al.
6,789,358 B2 9/2004 Procton et al.
7,114,293 B2 10/2006 Purlee
D549,850 S 8/2007 Perlman
7,263,808 B2 * 9/2007 Massey ..... E05C 9/1808 52/204.1
7,350,336 B2 4/2008 Bennett
7,389,611 B2 6/2008 Palenske
7,472,516 B2 1/2009 Pepper et al.
7,600,346 B2 10/2009 Meeks
7,644,539 B2 1/2010 Baxter
7,669,369 B2 3/2010 Henry et al.
7,788,863 B2 * 9/2010 Pepper ..... E06B 3/365 49/467
D627,488 S 11/2010 Abdollahzadeh et al.
7,878,559 B2 * 2/2011 Meeks ..... E05C 1/04 292/137
D638,958 S 5/2011 Van Camp et al.
8,074,699 B2 12/2011 Jones et al.
8,371,069 B2 2/2013 O'Sullivan
8,413,383 B2 4/2013 Van Camp et al.
8,522,483 B2 9/2013 Van Camp et al.
D696,794 S 12/2013 Mossman
8,813,427 B2 8/2014 Meeks
D722,387 S 2/2015 Van Camp
8,991,100 B2 3/2015 Van Camp
8,991,101 B2 * 3/2015 Van Camp ..... E06B 1/70 49/303
D733,927 S 7/2015 Van Camp
9,316,041 B2 * 4/2016 Olson ..... E06B 3/365
9,528,314 B2 12/2016 Mitchell
2002/0194787 A1 12/2002 Bennett
2003/0005644 A1 1/2003 Reithmeyer et al.
2004/0139667 A1 * 7/2004 Massey ..... E05C 9/1808 52/204.1
2004/0200153 A1 10/2004 Khanlarian
2004/0256858 A1 * 12/2004 Governale ..... E05C 1/06 292/1
2005/0210754 A1 9/2005 Ferrell
2006/0053695 A1 3/2006 Palenske
2006/0174545 A1 8/2006 Young
2006/0283087 A1 12/2006 Baxter
2006/0283090 A1 12/2006 Moody
2007/0227076 A1 10/2007 Braun
2008/0110100 A1 5/2008 Heppner
2008/0229669 A1 9/2008 Abdollahzadeh et al.
2009/0199486 A1 8/2009 Wemiund et al.
2010/0107503 A1 * 5/2010 Chapman ..... E05C 1/04 49/365
2010/0257789 A1 10/2010 Meeks
2013/0047518 A1 * 2/2013 Van Camp ..... E06B 1/70 49/468
2013/0199100 A1 8/2013 Van Camp et al.
2016/0145931 A1 * 5/2016 Meeks ..... E06B 1/70 49/468
2016/0340968 A1 11/2016 Mitchell

OTHER PUBLICATIONS

American Architectural Manufacturers Association, AAMA AG-11 AAMA Glossary (58 pgs.), believed to be available as of 2011, pp. 50 ("threshold"), 54 ("weatherstrip"), (http://www.aamanet.org/general/1/241/skylight-glossary-of-terms, accessed on Mar. 20, 2013).

Association of Millwork Distributors, Millwork Principles and Practices (6 pgs.), believed to be available as of 2010, pp. cover page, 130 (door sill), 131 (threshold), 160 (adjustable sill), 162 (weatherstrip).

Combo Aluminum Products, 50th Anniversary Catalog (59 pgs.), believed to be available 2008, cover page, pp. 1, 28 (hardwood cap), 31 (composite cap), 45 (foam weather-strip), (http://www.comboaluminum.com/Catalog/Combo_Aluminum_Catalog.pdf, accessed Mar. 20, 2013).

Endura Products, Glossary, 7 pages ("Cap/Riser", "Sill", "Weatherstrip"), available as of Aug. 22, 2011 (http:// www.enduraproducts.com/technical-info/glossary.aspx, accessed Mar. 20, 2013).

(56) References Cited

OTHER PUBLICATIONS

English abstract of EP0327840, last viewed Aug. 19, 2015, 2 pgs.
Official Action of U.S. Appl. No. 13/215,905, dated Feb. 15, 2013, 21 pgs.
Official Action of U.S. Appl. No. 13/215,905, dated Nov. 14, 2012, 18 pgs.
Profile Selection Guide Building Products Division (3 pgs.), Schlegel Systems, Inc., believed to be available as of Jun. 2008, page entitled T-Slot APTUS® TPE Weatherseals.
ThermaTru Doors Product Manual, Comp 13, Comp11, Jan. 2011 (online). Designs shown therein known at least as early as Aug. 24, 2010. Retrieved on Mar. 3, 2011: <URL: www.thermatru.com/customer-support/technical-manuals/ArchComp/Comp-12-14.pdf>; <URL: http://wvvw.thermatru.com/customer-support/technical-manuals/manuals/ArchComp/Comp11.pdf>, 6 pgs.
ThermaTru Doors Product Manual, Comp 13, Kerf Door Bottom, Jun. 2005, 2 pgs.
ThermaTru Doors, Sills Product Manual, Comp 11, Self-Adjusting Thermal Break Sill, Jun. 2005, 4 pgs.
Window & Door Manufacturers Association, The Door Glossary (9 pgs.), AAMA/WDMA/CSA 101/I.S.2/A440-11, NAFS—North American Fenestration Standard/Specification for Windows, Doors, and Skylights, believed to be available 2011, (https://www.wdma.com/TechnicalCenter/TheDoorGlossary/tabid/84/Default.aspx, accessed on Mar. 20, 2013).
Window & Door Manufacturers Association, The Window Glossary (11 pgs.), AAMA/WDMA/CSA 101/I. S.2/A440-11, NAFS—North American Fenestration Standard/Specification for Windows, Doors, and Skylights, believed to be available 2011, (https://www.wdma.com/TechnicalCenter/TheWindowGlossary/tabid/109/Default.aspx, accessed on Mar. 18, 2013).

* cited by examiner

ENTRYWAY WITH ARTICULATING THRESHOLD

PRIORITY

This application is a continuation of application Ser. No. 14/717,194 filed on May 20, 2015, the contents of which are incorporated herein by reference.

FIELD OF DISCLOSURE

The present disclosure relates generally to entryway systems for residential and commercial buildings. More particularly, the present disclosure relates to threshold assemblies of entryway systems. The present disclosure also relates to components of threshold assemblies, such as threshold caps, door sweeps and pin captures.

BACKGROUND

Entryways provide the necessary ingress and egress from residential and commercial buildings. Entryway systems used in building construction generally include a pair of vertically extending door jambs and a head jamb that frame the entryway and receive at least one hinged door panel. An elongated threshold assembly is generally attached at its ends to the bottoms of the door jambs, and spans the bottom of the entryway. Many modern threshold assemblies include a threshold cap disposed with respect to the threshold assembly to underlie a closed door mounted in the entryway. In some instances, the threshold cap is manually adjustable (using, for example, lifting mechanisms) in a vertical direction to engage and form a seal with the bottom of the door panel or a flexible sweep attached thereto.

Manufacturers of entryway systems, and components thereof, continue to seek designs that provide a durable, weather-tight seal. The goal of these components is to function as a system to prevent the unwanted infiltration of air or water through the entryway when the door panels are closed. One known problem is that houses can settle after construction, thus compromising the weather sealing of the door panel due to movement of the mating components from their initial installed position. In the past, a homeowner could vertically adjust the threshold cap manually in order to correct this issue. Experience has shown, however, that homeowners rarely used the adjustment features of the prior art, and even more rarely made the type of adjustments that result in an optimal seal. Accordingly, a need continues to exist for an entryway system with components that improve the ability to seal out air and water along the bottom of the door panel even as the fit between a door panel and the threshold changes.

SUMMARY

The present disclosure describes an articulating threshold cap for use with a sill. The cap may include a substantially rigid body. The body can have a top wall, a first channel disposed below the top wall, the first channel configured to be engaged with a dam of the sill, and a second channel disposed below the top wall. The cap may also include a spring positioned below the top wall and at least partially within the second channel. The spring is configured to bias at least a portion of the top wall upward.

In other embodiments, the present disclosure describes a threshold having a sill having a dam, and a cap on the dam, the cap comprising an interior end and an exterior end, the interior end adjustably biased upwardly by a spring. When the interior end is forced downward, the exterior end shifts upward.

In other embodiments, the present disclosure describes a threshold. The threshold includes a substrate, a tread surface, a dam extending upward relative to an interior end of the tread surface, and an adjustable threshold cap engaged with the dam for rotating relative to the dam without a fixed pivot point.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
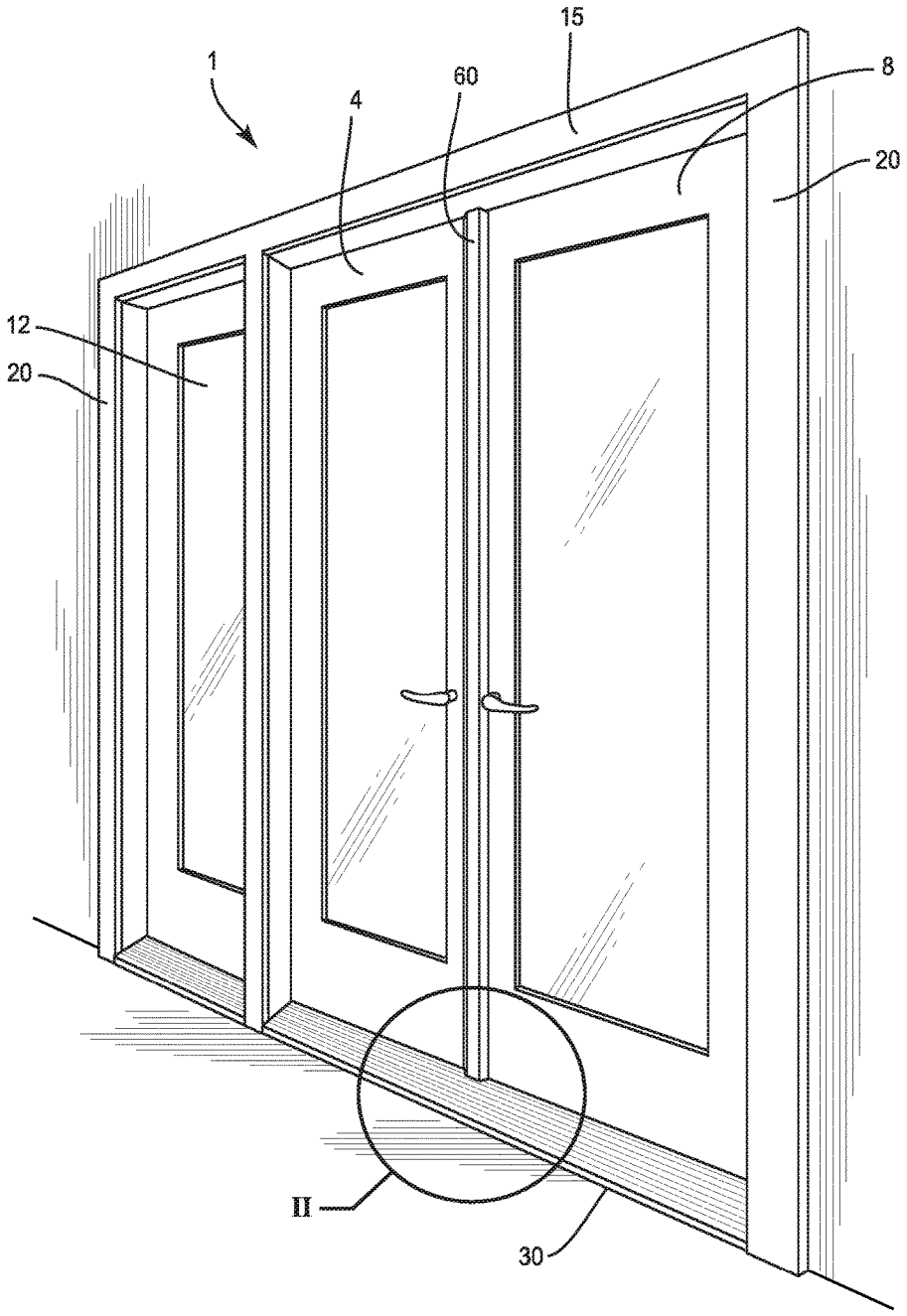
FIG. 1 shows a schematic of an entryway that may benefit from the components disclosed herein.

FIG. 1 schematically shows an entryway 1 that may incorporate one or more components of the present disclosure. The illustrated entryway 1 includes a French door arrangement with a first door panel 4 and a second door panel 8. The entryway 1 is also shown with a sidelight 12. The top of the entryway 1 includes a header 15, and the edges of the entryway 1 can be defined by side jambs 20. A threshold assembly 30 extends along the bottom of the entryway 1. The configuration of the entryway 1 shown in FIG. 1 is provided as an example only and is not intended to limit the scope of this disclosure. Particularly, the entryway 1 may include only a single door panel, a double door entryway, or even a larger plurality of door panels.

The illustrated embodiments of the present disclosure apply primarily to in-swing type entryways where the door panel is within the interior of the building when the door panel is open. However, several features and components described in this disclosure operate equally well if applied to an out-swing type entryway. Therefore, unless expressly noted, the type of entryway, e.g., in-swing or out-swing, should not affect the scope of this disclosure. As used herein, the terms interior, inner, inward, etc., and the terms exterior, outer, outward, etc., are used to describe relative positions of features with respect to the entryway 1 and the inside and outside of a corresponding building. It will be appreciated that several of the components discussed herein may be reversible, or symmetrical, such that the side that faces inward in one embodiment may be able to function while facing outward in another embodiment. Also, as used herein, the width direction extends from an interior to an exterior of a building, or vice versa. The length direction extends relatively between the side jambs 20 of the entryway. The height direction extends substantially along the vertical direction and parallel with the major axis of the side jambs 20. As used herein, the terms "rigid" and "resilient" are used with respect to one another. Therefore when an element made from rigid material interacts with an element made from a resilient material, the resilient element will deform more readily than the rigid element.

Figure 2:
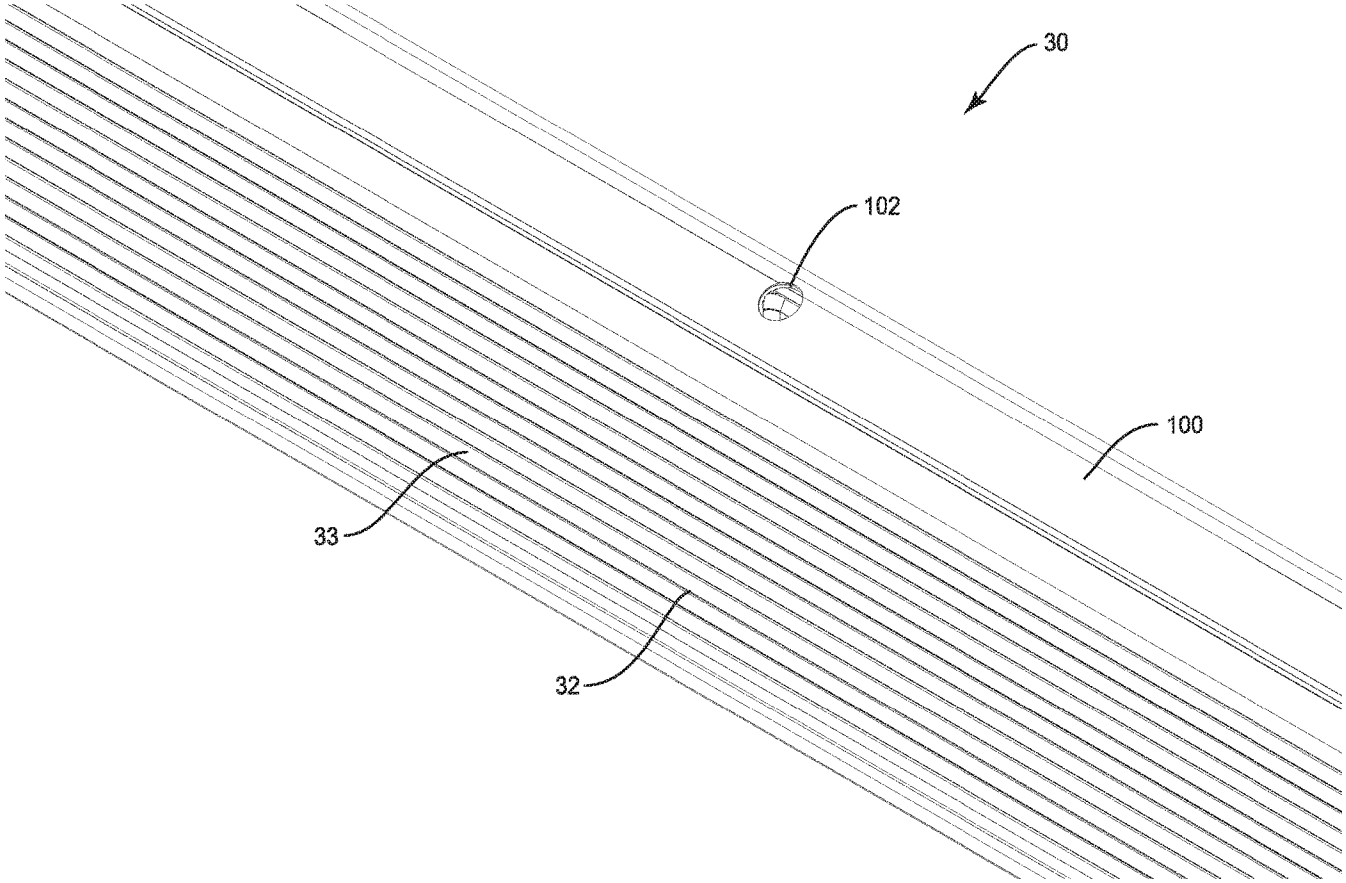
FIG. 2 shows a threshold assembly according to an embodiment of the present disclosure.

FIG. 2 shows a portion of the assembled threshold assembly 30 from area II of FIG. 1. The threshold assembly 30 includes a sill deck 32 providing a tread surface 33, and a threshold cap, or simply a cap 100. In the illustrated embodiment, the cap 100 includes an optional aperture 102 that faces upward and can be positioned along the cap 100 to correspond with an optional astragal 60 (as shown in FIG. 1) positioned between the first door panel 4 and the second door panel 8. The astragal 60 may be provided with a bolt pin extending from the bottom of the astragal 60 and through the aperture 102 to fix an inactive one of the door panels 4, 8 in a closed position. In embodiments with a single door panel, or in embodiments where a movable astragal 60 is not used, the aperture 102 is omitted.

Figure 3:
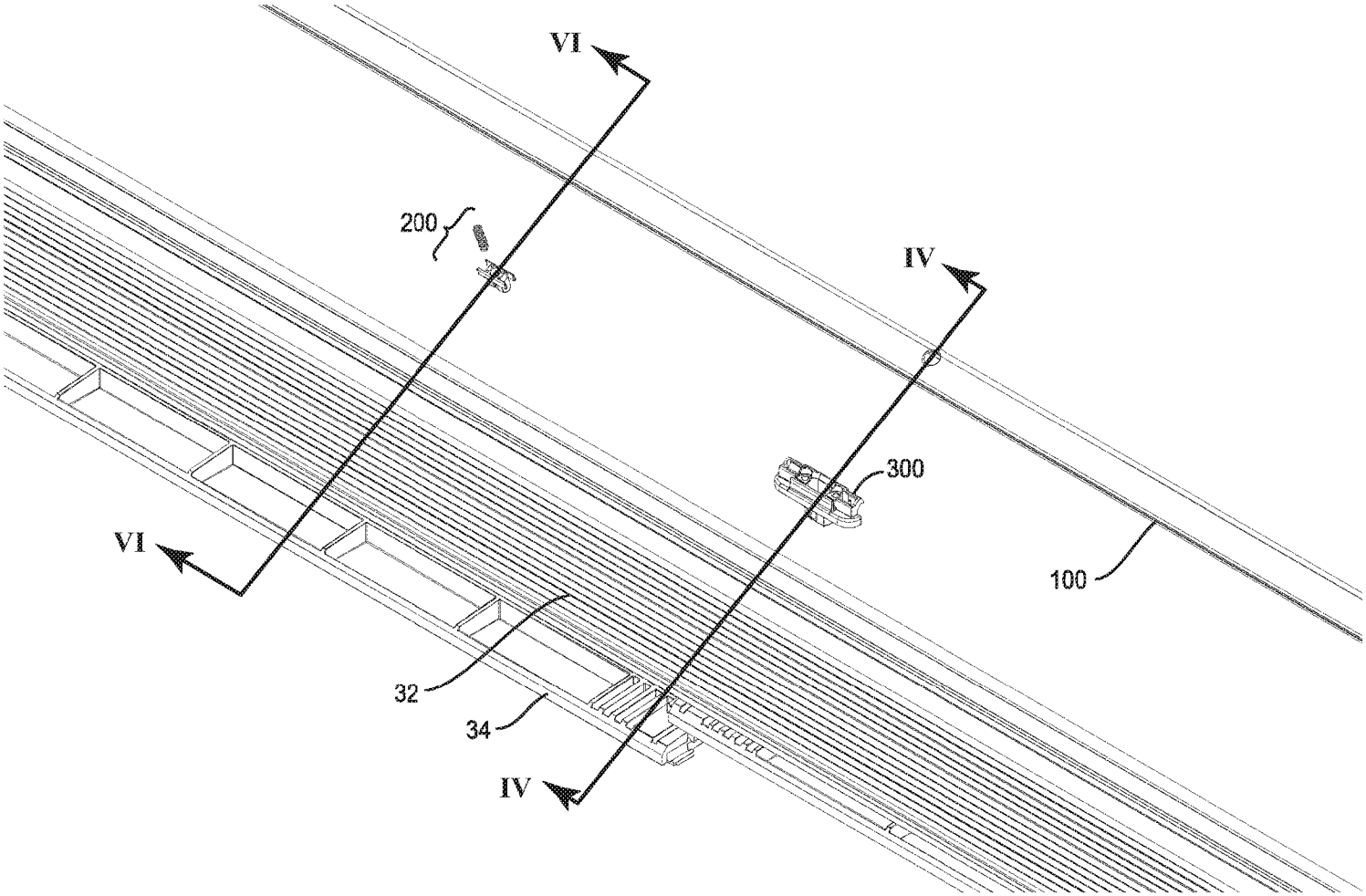
FIG. 3 shows an exploded view of the threshold assembly shown in FIG. 2.

FIG. 3 shows an exploded view of the portion of the threshold assembly 30 shown in FIG. 2. The exploded view shows the cap 100, a spring assembly 200, a pin capture 300, the sill deck 32, and a sill or substrate 34. The combination of the cap 100 and at least one spring assembly 200 may be referred to herein as a threshold cap or cap system. The spring assembly 200 applies a force to the cap 100 to allow the cap system to be self-adjusting. The manner of assembling the elements shown in FIG. 3 will be better understood in view of FIGS. 4-6 as discussed below.

Figure 4:
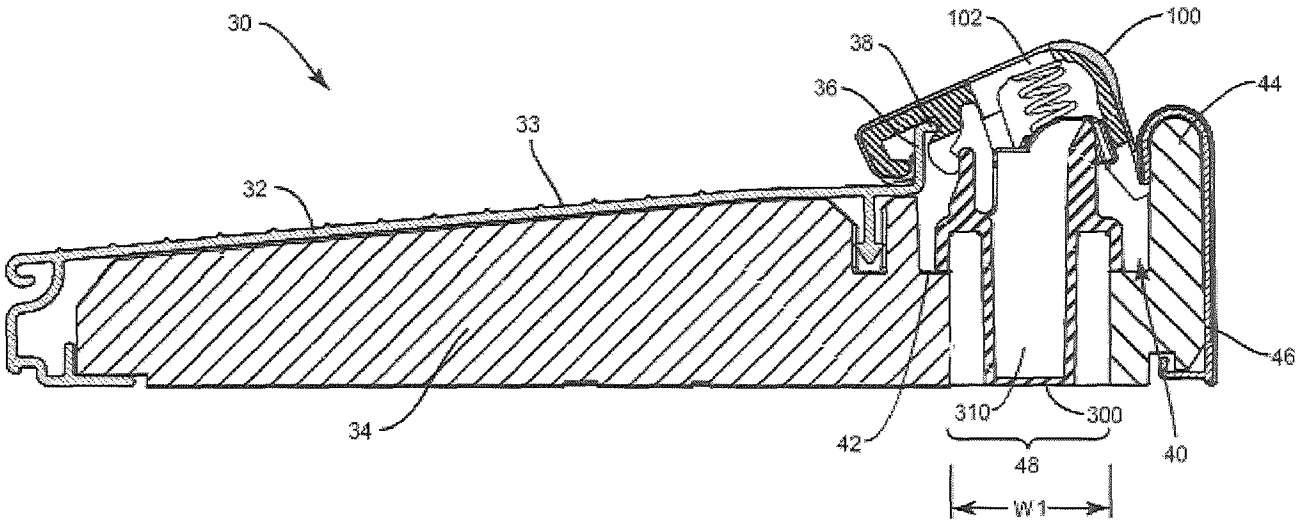
FIG. 4 shows a cross sectional view of the threshold assembly at plane IV in FIG. 3.

FIG. 4 shows a cross section of FIG. 3 at plane IV. As shown, the threshold assembly 30 includes the sill deck 32 disposed upon a substrate 34. A dam 36 extends upwardly from an internal end of the sill deck 32. In some embodiments, the dam 36 may be formed as part of the sill deck 32. In other embodiments, the dam 36 may be formed separate from the sill deck 32. The dam 36 may include a lip 38 at the top thereof. The lip 38 may extend substantially horizontally in an inward direction. Interior of the dam 36, a sill channel 40 may be formed. The sill channel 40 can be described as upwardly open. The sill channel 40 may have an exterior wall 41 formed at least partially by the dam 36. The sill channel 40 can have a lower surface provided by a floor 42, which may be at least partially defined by the substrate 34. An interior wall 43, which can be formed at least partially by a nosing 44, completes the sill channel 40. The interior wall 43 has an exterior surface 45. The nosing 44 may be formed as an integral part of the substrate 34 as shown, or the nosing 44 may be separately attached to the substrate 34. In several embodiments, a decorative nosing cover 46 may be provided over and around the nosing 44.

The illustrated cross section of FIG. 4 bisects the aperture 102 of the cap 100. The pin capture 300 corresponds with the location of the aperture 102, and is therefore visible within FIG. 4. The pin capture 300 provides a blind hole 310 to accept an astragal bolt pin (not shown). In the illustrated embodiment, the pin capture 300 is taller than the sill channel 40. Therefore, a bore 48 may be provided into the floor 42 to position the pin capture 300 and provide a sufficient depth for the blind hole 310. The bore 48 may have a width W1. As shown, not all portions of the cap 100 lie within the plane of the illustrated cross section in FIG. 4. This is because lower portions of the cap 100 may be removed or notched so that the pin capture 300 provides sufficient clearance below the cap 100. One of ordinary skill in the art will appreciate that FIG. 4 reflects embodiments having a French door system as illustrated in FIG. 1, but may not apply to single door embodiments.

Figure 5:
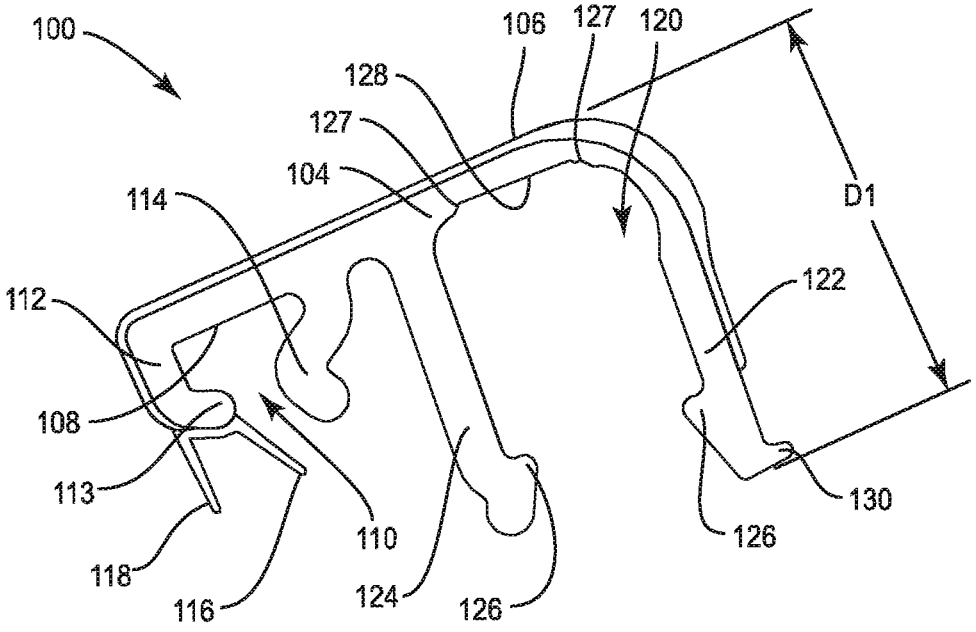
FIG. 5 shows a cross sectional view of the uninstalled cap at plane VI in FIG. 3.
Figure 6:
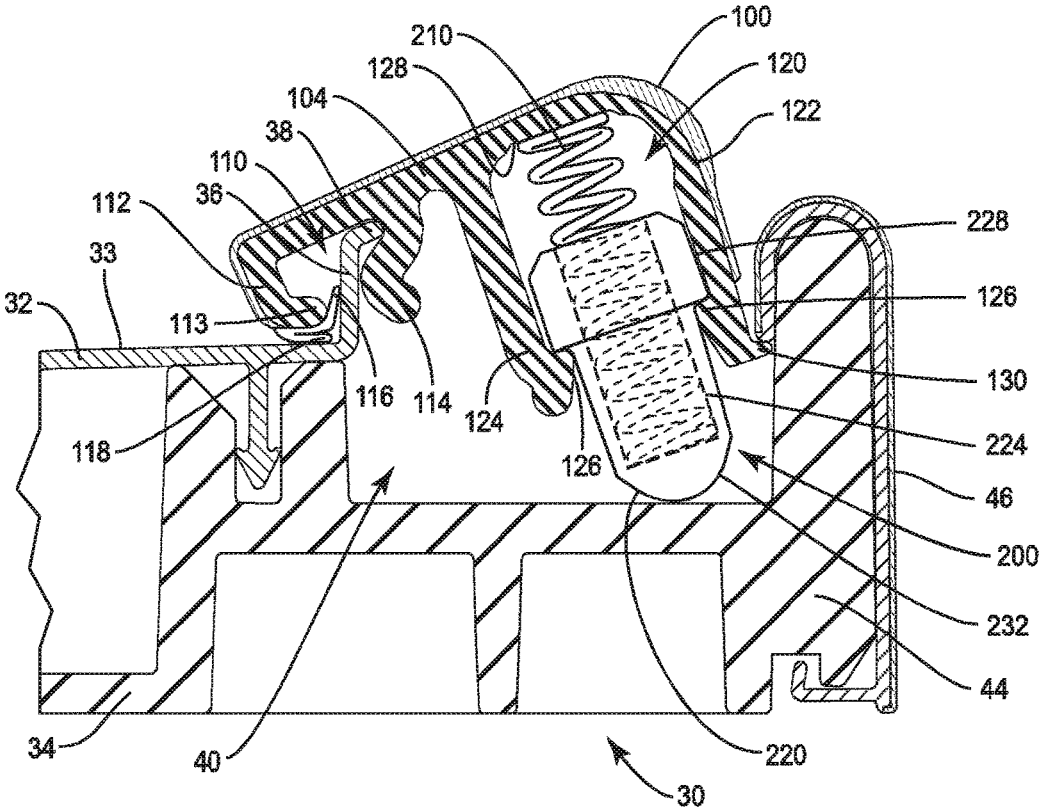
FIG. 6 shows a cross sectional view of the threshold assembly at plane VI in FIG. 3.
Figure 7:
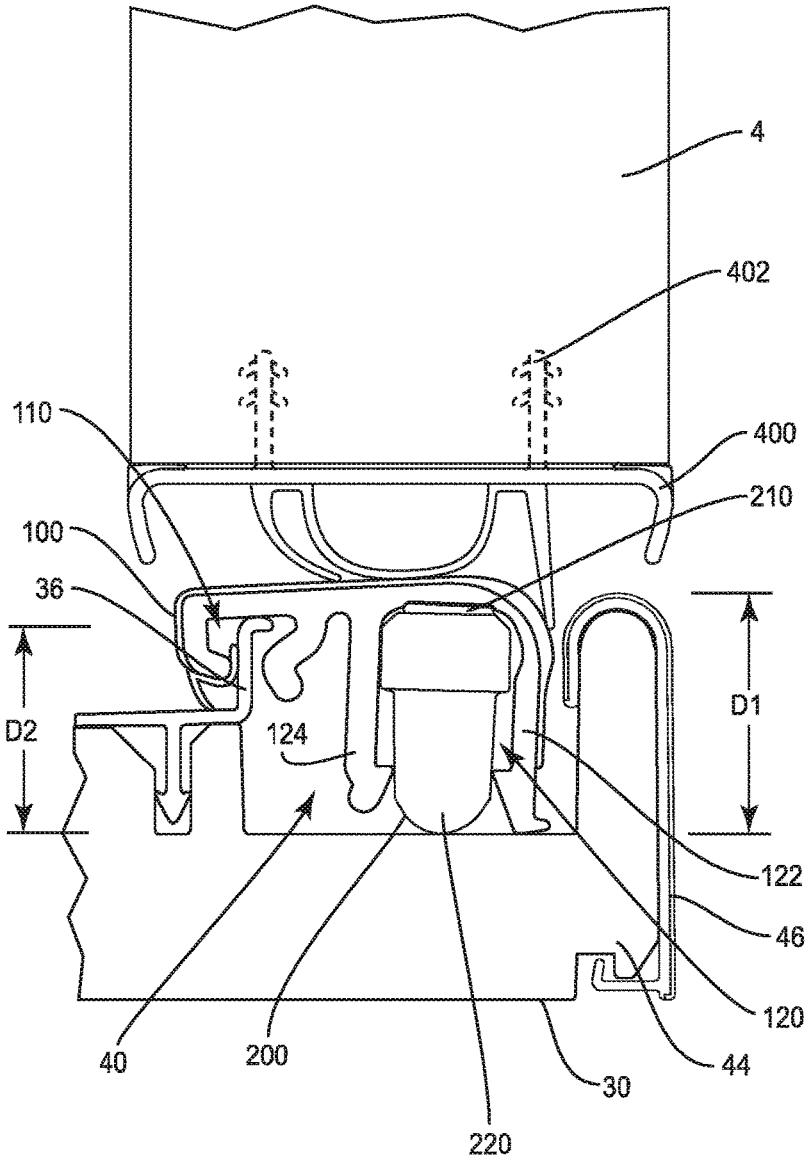
FIG. 7 shows the cap in a depressed position in contact with a door sweep of a first embodiment.

The structure and operation of the cap 100 and the spring assembly 200 in certain embodiments will now be described with respect to FIGS. 5-7. The elements shown and described herein include several optional features that are found in certain embodiments. FIG. 5 shows a profile view of the cap 100 prior to installation with the threshold assembly 30. FIG. 6 shows a first embodiment of the cap 100 installed with the threshold assembly 30 in an uppermost position. The uppermost position of the cap 100 generally occurs when a corresponding door panel (not shown in FIG. 6) is in an open position. FIG. 6 is a cross section through plane VI of FIG. 3. FIG. 7 shows the cap 100 in a lowermost sealing position compressed by interaction with a door sweep 400 as shown, or alternatively with the bottom of a door panel 4 when the door panel 4 is in a closed position. The spring assembly 200 may be provided to bias the cap 100 upwardly toward the uppermost position. The cap 100 is thus able to self-adjust or articulate between the uppermost position and the lowermost position with the help of the spring assembly 200.

The cap 100 may be described as a body 101 of substantially rigid material. In some embodiments, the cap 100 is created by an extrusion process using a polymer such as PVC that will form a rigid structure when cooled. Use of an extrusion process is one way to provide the cap 100 with a constant profile along its length. In some embodiments, the constant profile may be modified by removing or notching out material that would otherwise interfere with desired components. For example, material may be removed to avoid interference with the pin capture 300 as shown in FIG. 4.

As possibly best seen in FIG. 5, the cap 100 includes a top wall 104. The top wall 104 may have an upper side 106 that can be substantially planar. The upper side 106 may be configured to help form a seal when a door panel 4 is closed (shown in FIG. 7). The top wall 104 also has a lower side 108. In the illustrated embodiment, a first channel 110 is provided below the top wall 104. The first channel 110 may be configured to engage with the dam 36 of the sill deck 32 (shown in FIG. 6). The first channel 110 can be at least partially defined by the top wall 104, by a first leg 112 extending from and below the top wall 104, and by a second leg 114 extending from and below the top wall 104. The first leg 112 may be positioned on an exterior side of the dam 36, and the second leg 114 may be positioned on an interior side of the dam 36 such that at least a top of the dam 36 is disposed within the first channel 110 between the first leg 112 and the second leg 114.

The shape of the first leg 112 and the second leg 114 can provide the first channel 110 with a relatively narrow entrance and that widens toward the top wall 104. In the first illustrated embodiment of FIGS. 5-7, the first leg 112 has a tip 113 that bends in an inward direction. The second leg 114 has been configured with an outwardly convex bend. The narrow entrance can provide an improved fit of the cap 100 over the dam 36. The first channel 110 in combination with the sealing fins (discussed below) can provide an interference friction fit engagement with the dam 36. The widening portion of the first channel 110 helps accommodate the lip 38.

By configuring the cap 100 to include the first leg 112 outside of the dam 36, the cap 100 extends in an exterior direction outside of the bounds of the sill channel 40, unlike many prior art threshold caps. Also, as discussed more below, the first leg 112 moves as the cap 100 articulates such that a portion of the cap 100 beyond the widthwise dimensions of the sill channel 40 can adjust along a vertical direction.

The first channel 110 can provide a sealing function in cooperation with the dam 36. In one embodiment, the first leg 112 may be provided with at least a first sealing fin 116 on a distal end thereof. At least the first sealing fin 116 can be formed of a resilient material, one preferably more resilient than at least the top wall 104 of the cap 100. Use of a soft resilient material provides the first sealing fin 116 with the ability to flex and form a seal against substantially rigid components. In one instance, the first sealing fin 116 is formed during formation of the cap 100 by co-extruding the cap material and the fin material.

In the illustrated embodiment of FIGS. 5-7, the first leg 112 includes both a first sealing fin 116 and a second sealing fin 118. The first sealing fin 116 may be described as a dam sealing fin because it is positioned with respect to the cap 100 to seal against the dam 36, particularly the exterior of the dam 36. The second sealing fin 118 may be describes as a deck sealing fin because it is positioned with respect to the cap 100 and the first leg 112 to seal against the tread surface 33 of the sill deck 32. Of note, the first sealing fin 116 can be bent upward during installation of the cap 100 upon the dam 36. This upward curve of the first sealing fin 116 is believed to result in a robust seal as the resilient material of the first sealing fin 116 attempts to rotate back to its initial uninstalled position shown in FIG. 5.

The cap 100 may also define a second channel 120 below the top wall 104. The second channel 120 may be at least partially defined by the top wall 104, a first side wall 122, and a second side wall 124. The first side wall 122 may be spaced from and inwardly disposed relative to the second side wall 124. Both the first side wall 122 and the second side wall 124 can extend relatively downward from and below the top wall 104. The first side wall 122 can extend from the top wall 104 by a first distance D1. As seen in FIG. 7, D1 can be selected so that the distal end of the first side wall 122 can abut the bottom surface of the sill channel 40 to define the lowermost position of the cap 100 with the top wall 104 equal to or slightly above the top of the nosing cover 46.

The second channel 120 of the illustrated embodiment can have other advantageous features. For example, a retaining finger 126 may be provided near the bottom end of each of the first and second side walls 122, 124. The retaining fingers 126 extend toward one another to narrow the entrance of the second channel 120 and provide a pair of abutment surfaces for retaining the spring assembly 200. The lower side 108 of the top wall 104 may be provided with a groove 128 between boundaries 127 at a location corresponding to the top of the second channel 120. The groove 128 may interact with a portion of the spring assembly 200 as discussed later. Further, the first side wall 122 may include a projection 130 extending away from the second side wall 124. The projection 130 may be used to limit the uppermost travel position of the cap 100 by abutting the nosing 44 or a portion of the nosing cover 46 as shown in FIG. 6.

FIGS. 6 and 7 show the cap 100 interacting with a spring assembly 200. In most embodiments, several spring assemblies 200 will be provided that are spaced along the length of the threshold assembly 30. Use of a plurality of spring assemblies 200 increases the overall biasing force on the cap 100. Further, spacing of the spring assemblies 200 can increase the effectiveness of the cap 100 by supporting some locations along the length of the cap 100 at different heights compared to other locations along the cap 100. This is important to seal the margin between the door panel 4 and the threshold assembly 30 when the margin is not consistent along the length of the threshold assembly 30.

Staying with FIG. 6, the spring assembly 200 will be further described. The spring assembly 200 can include a spring 210, such as a coil spring, that resists compression. The term "spring", as used herein should be considered broadly to cover any structure capable of providing a resilient biasing force to the cap 100. Therefore other types of springs beside coil springs may be used, for example leaf springs. The spring assembly 200 may also include a holder for the spring 210, referred to herein as a plunger 220. The spring 210 is provided below the cap 100, and more specifically below the top wall 104. The spring 210 is provided at least partially within the sill channel 40. In embodiments where the cap 100 has a second channel 120, the spring assembly 200 may be at least partially disposed within the second channel 120. An upper end of the spring 210 may fit within the groove 128 in the top wall 104. The groove 128 may help properly position and stabilize the spring 210 to maintain a more consistent force direction relative to the top wall 104. The plunger 220 may include a cavity 224 for positioning a lower end of the spring 210. The lower end of the plunger 220 may have a curved radius to allow the plunger 220 to pivot and slide more easily with respect to the lower surface of the sill channel 40. A top portion 228 of the plunger 220 may be wider than a lower portion 232 thereof. The top portion 228 can be maintained within the second channel 120 by contact with the abutment surface formed by the retaining fingers 126 when the cap 100 is in the uppermost position. The lower portion 232 of the plunger 220 may then extend from the entrance of the second channel 120, at least when the cap 100 is in the uppermost position. In the uppermost position of the cap 100, as seen in FIG. 6, the projection 130 may contact the nosing 44 or the nosing cover 46 to help constrain the upward range of motion of the cap 100.

Shifting to FIG. 7, the lowermost position of the cap 100 is shown. In the lowermost position, a lower distal end of either the first side wall 122 or the second side wall 124 may contact the bottom of the sill channel 40, thereby limiting the downward motion of the cap 100. When the cap 100 is forced to a lower position, the spring 210 is compressed and the plunger 220 may be forced further into the second channel 120. If downward motion is not limited by either of the first or second side walls 122, 124, the height D2 of the plunger 220 may serve the same function, forming a stop between the top wall 104 and the bottom of the sill channel 40. If D1 is greater than or equal to D2, the first side wall 122 provides the downward limiting means.

The motion of the cap 100 between the positions shown in FIGS. 6 and 7 will now be further described. The motion, adjustment, or articulation of the cap 100 between an uppermost position and a lowermost position may be approximated as a rotating or pivoting action having the dam 36 as a fulcrum. In the illustrated embodiment, the engagement of the cap 100 with the dam 36, via the first channel 110 for example, does not provide a fixed center of rotation or a specific fixed pivot point, pin, or axis. Therefore the terms rotate and pivot are used broadly and not intended to require a consistent center of rotation as may be the mathematical definition of rotation. Generally, use of the dam 36 as a fulcrum, positioned interior of a distal exterior end of the cap 100, results in the exterior end shifting upward when the interior end is forced downward away from the uppermost position of the cap 100. As seen when comparing FIGS. 6 and 7, the first channel 110 is sized to allow the lip 38 to slide along the lower side 108 of the top wall 104, and the dam 36 is able to shift within the entrance of the first channel 110.

To reiterate, a purpose of the cap 100 is to help form a water-tight, and also preferably an air-tight seal, below the bottom of a closed door panel 4 (as shown in FIG. 7). In operation, the cap 100 may achieve the uppermost position shown in FIG. 6 when the door panel 4 is open. When the door panel 4 is closed, the cap 100 is likely to be flexed downward to a position lower than the uppermost position, potentially as low as the lowermost position shown in FIG. 7. The spring assembly 200 biases the cap 100 upward toward the door panel 4 even when the door panel 4 is closed, thereby providing a pressing force that improves the potential seal below the door panel 4. By using a cap system that is able to adjust relative to the sill without being specifically adjusted by the user, the cap 100 is able to provide an improved seal that accommodates varying size gaps between the threshold assembly 30 and the door panel 4. The gaps of various sizes can occur along the length of the threshold assembly 30 at any given time, or the size of the gaps may vary over time. The gap may vary over time as components shift and settle, or as components expand and contract due to changes in temperature or humidity.

Varying methods of assembling the elements of the threshold assembly 30 can be understood in view of FIGS. 6 and 7. The ends, along the length direction, of the sill channel 40 can be at least initially open. The ends, along the length direction, of the cap 100 may also be at least initially open. Thus, combining the cap 100 on the dam 36 may be done by sliding the first channel 110 along the dam 36 along the length direction. Further, the spring assemblies 200 may be slid into position along the cap 100 because of the open ends of the cap 100. Alternatively, the cap 100 may be generally pressed down over the dam 36. This method may be preferred where a pin capture 300 could prohibit sliding of the cap 100 along the full length of the sill channel 40. In one embodiment, the cap 100 may be considered selectively positionable within the sill channel 40 when the cap 100 is shorter than the length of the sill channel 40. Having a cap 100 that is shorter than the underlying sill channel 40 and substrate 34 may also allow the cap 100 to be removed and replaced after the entryway 1 has been fully installed within a building.

In some embodiments, the desired seal between the threshold assembly 30 and the door panel 4 is provided by the cap 100 used in combination with a door sweep 400 as seen in FIG. 7. The door sweep 400 may be attached to the bottom of a door panel 4 for movement therewith. The illustrated door sweep 400 of FIG. 7 has kerf legs 402 configured to engage kerf slots formed in the bottom stile of the door panel 4. In other embodiments, the door sweep 400 may be attached to the door panel 4 with staples, adhesive, or other known means. Each door sweep 400 may include at least one portion of flexible resilient material such as PVC that is configured to contact at least a portion of the cap 100, preferably the upper side 106 of the top wall 104, to form the desired seal. In several embodiments, a door sweep 400 may have several portions of resilient material to create more than one line of sealing between the door panel 4 and the threshold assembly 30 along with the width direction of the entryway 1.

Figure 8:
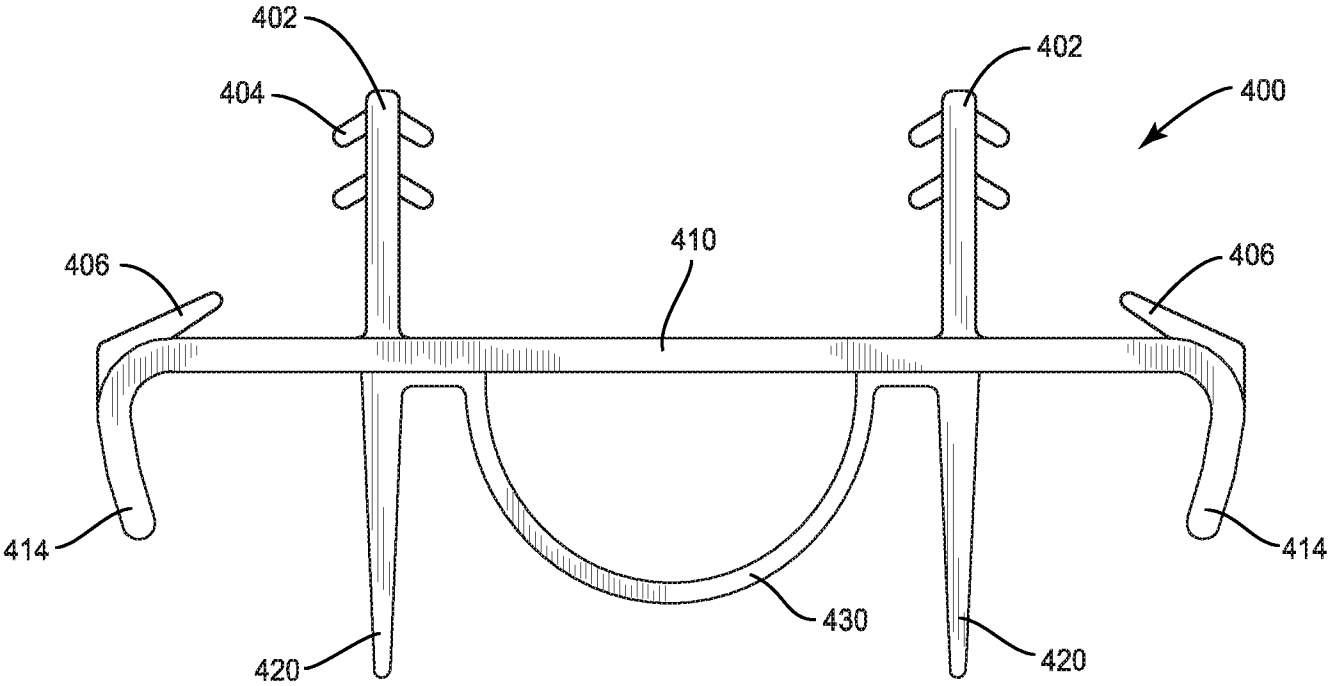
FIG. 8 shows a profile view of the first door sweep in an initial position.

FIG. 8 shows a first embodiment of the door sweep 400 in a free-state condition. The door sweep 400 may include kerf legs 402 for engaging kerf slots of a door panel 4. The kerf legs 402 may have flexible projections 404 that provide a tight friction fit within the kerf slots. Panel fins 406 may be provided on each of the interior and exterior side of the door sweep 400 to minimize or eliminate any gaps between the door panel 4 and the door sweep 400. A rigid material may be used to form a base wall 410 that is intended to correspond with the bottom of the door panel 4. The base wall 410 may have downturned end portions 414 that form substantially rigid arms. These downturned end portions 414 may be colored or patterned to provide a pleasing appearance to the entryway 1 by minimizing the visual gap between the door panel 4 and the nosing cover 46. The downturned end portions 414 can also stiffen the door sweep 400 to provide rigidity at its ends and for an improved fit with the door panel 4.

The rigid downturned end portions 414 may also provide a functional benefit in conjunction with the self-adjusting cap system of the present disclosure. Particularly, the end portions 414 act as the leading edge of the door panel 4 as the door panel 4 is being closed. In some embodiments, the end portions 414 with initially contact an innermost side of the cap 100 and provide a force to deflect the cap 100 downward, away from the uppermost position thereof. By initially deflecting the cap 100 downward with the end portions 414, the resilient portions of the door sweep 400 may be subject to a reduction in stress, increasing the life of the door sweep 400, and reducing the potential for the door sweep 400 to stick against a raised cap 100 as the door panel 4 is being closed.

To form a seal with the rigid top wall 104 of the cap 100, each door sweep 400 may have at least one resilient portion configured to seal with the cap 100. The resilient portion may be co-extruded with the rigid material of the base wall 410 to form the door sweep 400. In the case of the first embodiment illustrated, the door sweep 400 includes a pair of sweep fins 420 projecting downward from the base wall 410. A sealing bulb 430 is positioned between the pair of sweep fins 420. The sweep fins 420 and the sealing bulb 430 can all formed from resilient materials that are configured to be deformed when contacting the top wall 104 of the cap 100 or other rigid portions of the threshold assembly 30 as shown in FIG. 7. The configuration of resilient portions of the door sweep 400 may be advantageous in that the door sweep 400 can be designed to be reversible. Therefore the installer does not have to determine an interior side and an exterior side of the door sweep 400. A symmetric design can also add stability under free-state high heat exposure and pre-assembly handling. The configuration of resilient portions of the door sweep 400 may also be advantageous because it can provide three separate sealing points between the door sweep 400 and portions of the threshold assembly 30, including the cap 100 and the nosing cover 46. Between the separate seal locations, pockets of air may be formed that can increase the thermal insulation properties of the entryway 1, as is known in the art.

Some of the unique features of the door sweep 400 of the first embodiment may be described in terms of the following paragraph:

Paragraph A: A door sweep for attachment to the bottom of a door panel comprising:

a base wall having at least one downturned end portion of a rigid material; and a resilient sealing portion comprising at least a bulb seal and a sweep fin, wherein the door sweep is mirror symmetric along a plane parallel with the door panel, such that the door sweep is reversible with respect to an interior and an exterior side of the door sweep.

Figure 9:
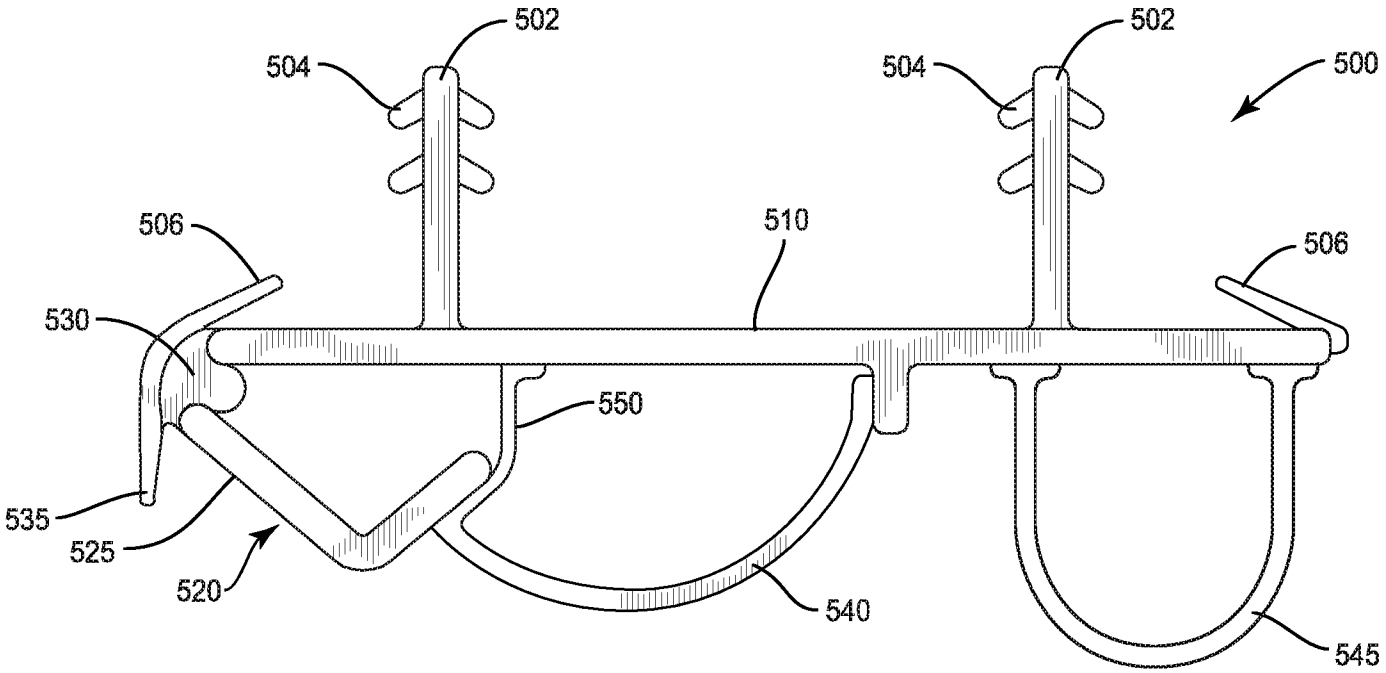
FIG. 9 shows a profile view of a second door sweep in an initial position.
Figure 10:
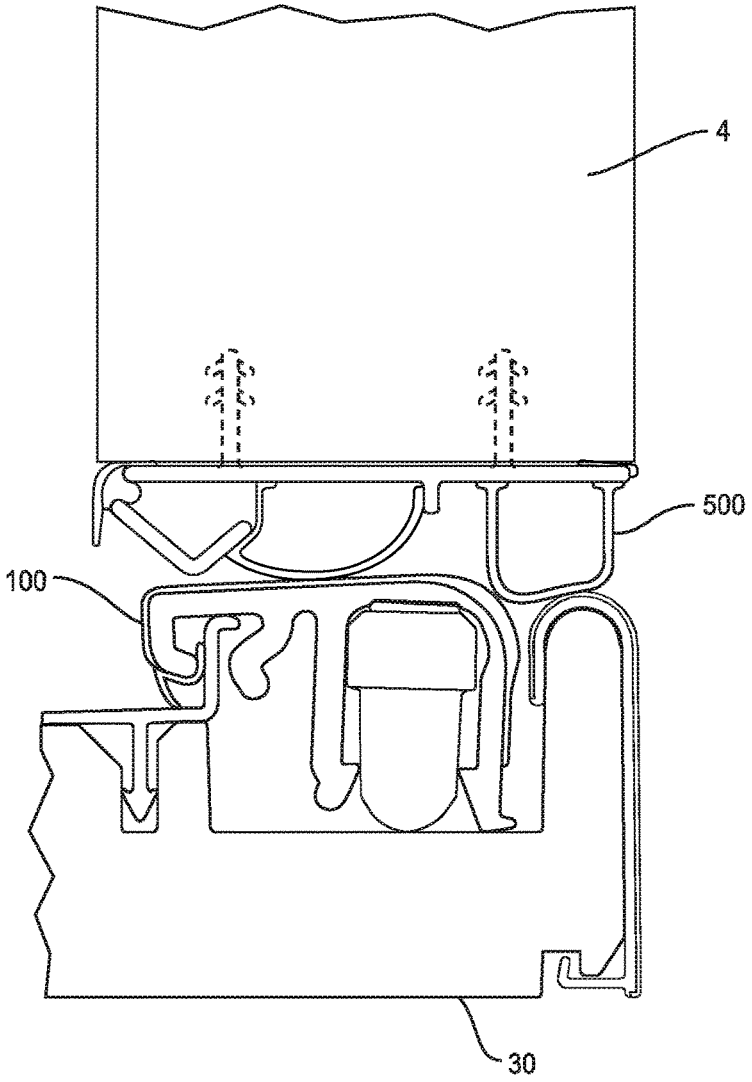
FIG. 10 shows the cap in a depressed position in contact with a door sweep of the second embodiment.

A second embodiment of a door sweep is shown in FIGS. 9 and 10. FIG. 9 shows the door sweep 500 in an undeformed or free-state. The cap 100 is shown in FIG. 10 in a sealing arrangement with a door sweep 500 according to a second embodiment. The second door sweep 500 may include kerf legs 502 for engaging kerfs of a door panel 4. The kerf legs 502 may have flexible projections 504 that provide a tight friction fit within the kerf slots. Panel fins 506 may be provided on each of the interior and exterior side of the second door sweep 500 to minimize or eliminate any gaps between the door panel 4 and the second door sweep 500. A rigid material may be used to form a base wall 510 that is intended to correspond with the bottom of the door panel 4.

The second door sweep 500 also includes a ramp portion 520 formed from a substantially rigid material. The ramp portion 520 is intended to float below the base wall 510 at an exterior side thereof. The ramp portion 520 is configured to be attached to, and capable of adjustment relative to, the base wall 510. The attachment may be via a living hinge 530 or other soft durometer joining material that has resiliency to bias the ramp portion 520 away from the base wall 510 while allowing for the ramp portion 520 to be rotated toward the base wall 510. The living hinge 530 may include a deflection fin 535 projecting downwardly from the hinge 530 to help deflect moisture away from the ramp portion 520. The ramp portion 520 is provided at the exterior side of the second door sweep 500 to be the leading edge of the door sweep 500 as it comes into contact with a raised cap 100. Therefore, like the downturned end portion 414 of the first door sweep 400, the ramp portion 520 is configured to deflect the cap 100 downward, away from the uppermost position thereof. By initially deflecting the cap 100 downward with the ramp portion 520, the resilient portions of the second door sweep 500 may be subject to a reduction in stress, increasing the life of the second door sweep 500, and reducing the potential for the door panel 4 to stick against a raised cap 100 as the door panel 4 is being closed. The ramp portion 520 provides a sloped surface 525 to reduce interaction forces with the cap 100 as the door panel 4 closes and the ramp portion 520 pushes the cap 100 downward.

To form a seal with the hard top wall 104 of the cap 100, each door sweep 500 may have at least one resilient portion configured to seal with the cap 100. The resilient portion may be co-extruded with the rigid materials forming the base wall 510 and the ramp portion 520 to form the second door sweep 500. In the case of FIG. 10, the second door sweep 500 may include a relatively exterior resilient bulb 540 and a relatively interior resilient bulb 545 projecting downward from the base wall 510. The resilient bulbs 540, 545 can deform when contacting the top wall 104 of the cap 100 or other rigid portions of the threshold assembly 30 as shown in FIG. 9. The configuration of resilient portions of the second door sweep 500 may also be advantageous because it provides for a pair of spaced apart sealing locations between the second door sweep 500 and portions of the threshold assembly 30, including the cap 100 and the nosing cover 46. The interior resilient bulb 545 may connect directly to the base wall 510 on each end thereof. The exterior resilient bulb 540 may connect to the base wall 510 as well as the ramp portion 520. An intermediate wall portion 550 may extend from where a trailing edge of the ramp portion 520 meets the exterior resilient bulb 540, to the base wall 510. The intermediate wall portion 550 can act to partition a space between the base wall 510 and each of the ramp portion 520 and the exterior resilient bulb 540 to help contain any water which may enter this space from proceeding further in an interior direction relative to the entryway 1.

The unique features of the door sweep 500 of the second embodiment may be described in terms of the following paragraphs:

Paragraph B: A door sweep comprising:

a base wall of relatively rigid material configured for attachment along a bottom stile of a door panel;

a ramp portion of relatively rigid material resiliently hinged to an edge of the base wall; and a resilient sealing portion attached below the base wall for forming a seal with a threshold assembly.

Paragraph C: The door sweep of paragraph B, wherein the resilient sealing portion comprises a pair of bulb seals.

Paragraph D: The door sweep of paragraph C, wherein one of the pair of bulb seals is joined to the ramp portion.

Paragraph E: The door sweep of paragraph D, wherein an intermediate wall portion of a resilient material joins the base wall to a trailing edge of the ramp portion.

Figure 11:
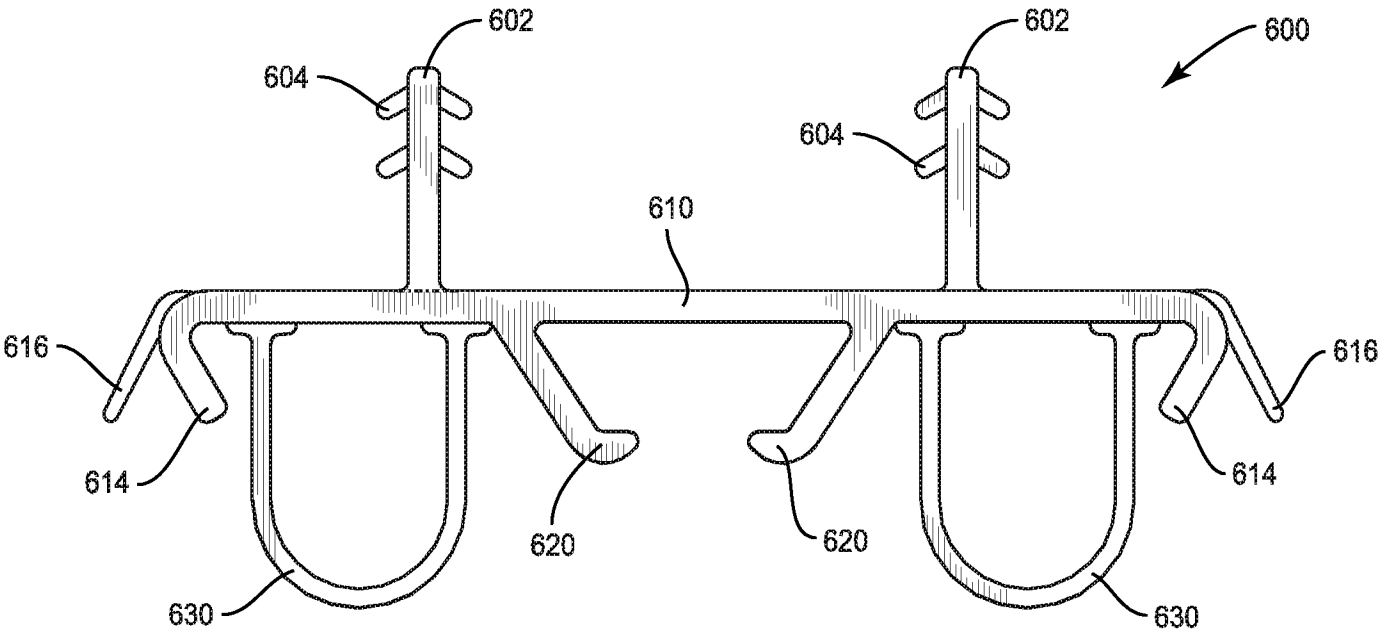
FIG. 11 shows a profile view of a third door sweep in an initial position.
Figure 12:
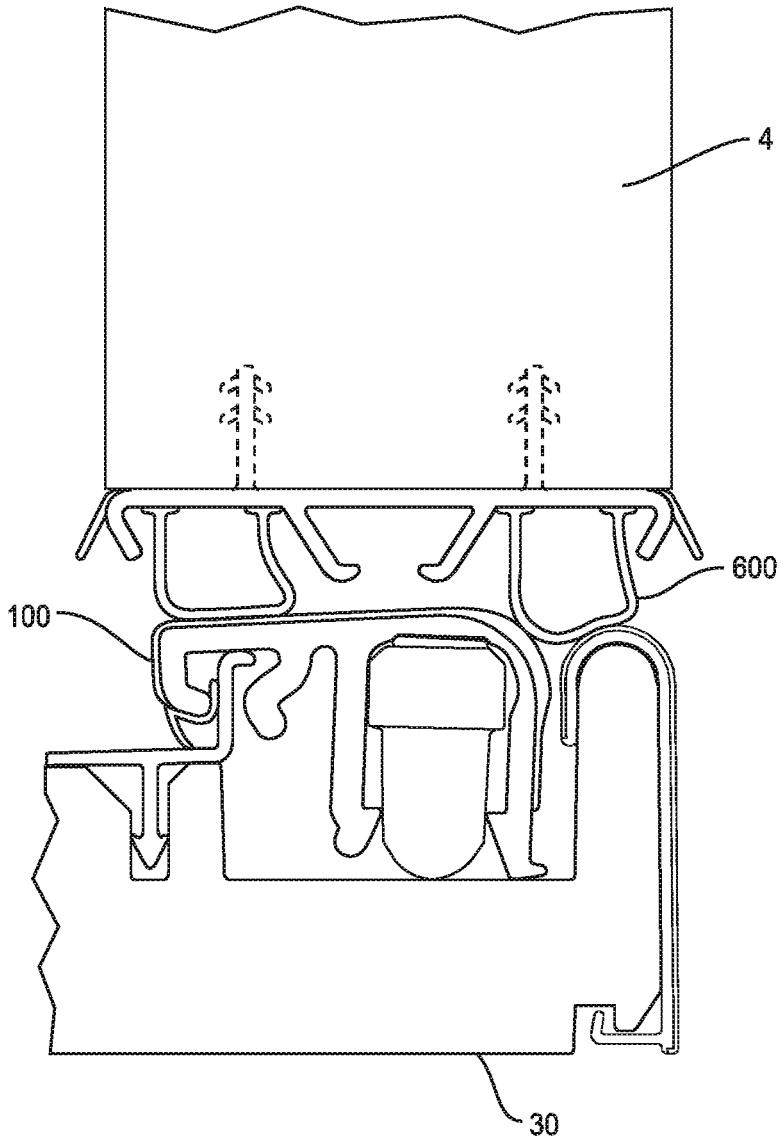
FIG. 12 shows the cap in a depressed position in contact with a door sweep of the third embodiment.

Turning to FIG. 11, a third door sweep 600 in an undeformed or free-state is shown. FIG. 12 shows the cap 100 is shown in a sealing arrangement with the third door sweep 600. The third door sweep 600 may include kerf legs 602 for engaging kerf slots of a door panel 4. The kerf legs 602 may have flexible projections 604 that provide a tight friction fit within the kerfs. A rigid material may be used to form a base wall 610 that is intended to correspond with the bottom of the door panel 4. The base wall 610 may have downturned end portions 614 that form substantially rigid arms. These downturned end portions 614 may be colored or patterned to provide a pleasing appearance to the entryway 1 by minimizing the visual gap between the door panel 4 and the nosing cover 46. Additionally or alternatively, cover fins 616 may be added for the same gap-hiding and pleasing appearance function.

The rigid downturned end portions 614 may also provide a functional benefit in conjunction with the self-adjusting caps 100 of the present disclosure. Particularly, the end portions 614 act as the leading edge of the door panel 4 as the door panel 4 is being closed. In some embodiments, the end portions 614 will initially contact an innermost side of the cap 100 and provide a force to deflect the cap 100 downward, away from the uppermost position thereof. By initially deflecting the cap 100 downward with the end portions 614, the resilient portions of the door sweep 600 may be subject to a reduction in stress, increasing the life of the door sweep 600, and reducing the potential for the door sweep 600 to stick against a raised cap 100 as the door panel 4 is being closed.

The third door sweep 600 also includes at least one stand-off 620 formed from a substantially rigid material. The at least one stand-off 620 is provided at a central region of the base wall 610. In the illustrated embodiment, the stand-off 620 extends below the base wall 610 by a distance greater than the downturned end portion 614. The at least one stand-off 620 may be configured to abut the top wall 104 of the cap 100 when the door panel 4 is closed as shown in FIG. 11. The stand-off 620 therefore can help limit the upward rebound of the cap 100 and may help prevent over-compression of the resilient sealing portions of the third door sweep 600.

To form a seal with the hard top wall 104 of the cap 100, each door sweep 600 may have at least one resilient portion configured to seal with the cap 100. The resilient portion may be co-extruded with the rigid materials forming the base wall 610 and the at least one stand-off 620 to form the third door sweep 600. In the case of FIG. 12, the third door sweep 600 includes a pair of resilient bulbs 630 projecting downward from the base wall 610 and flanking the at least one stand-off 620. The resilient bulbs 630 are configured to be deformed when contacting the top wall 104 of the cap 100 or other rigid portions of the threshold assembly 30 as seen in FIG. 11. The configuration of resilient portions of the third door sweep 600 may be advantageous because it provides for a pair of spaced apart sealing locations between the third door sweep 600 and portions of the threshold assembly 30, including the cap 100 and the nosing cover 46. The configuration of resilient portions of the door sweep 600 may also be advantageous in that the door sweep 600 is designed to be reversible. Therefore the installer does not have to differentiate between an interior side and an exterior side of the door sweep 600.

The unique features of the door sweep 600 of the third embodiment may be described in terms of the following paragraphs:

Paragraph F: A door sweep comprising:

a base wall of relatively rigid material configured for attachment along a bottom stile of a door panel;

at least one rigid stand-off extending from a bottom of the base wall near a central region thereof; and a resilient sealing portion attached below the base wall for forming a seal with a threshold assembly.

Paragraph G: The door sweep of paragraph F, wherein a base wall having at least one downturned end portion of a rigid material; and Paragraph H: The door sweep of paragraph F, wherein wherein the door sweep is mirror symmetric along a plane parallel with the door panel such that the door sweep is reversible with respect to an interior and exterior side of the door sweep.

Paragraph I: The door sweep of paragraph H, wherein the resilient sealing portion comprises a pair of bulb seals.

Figure 13:
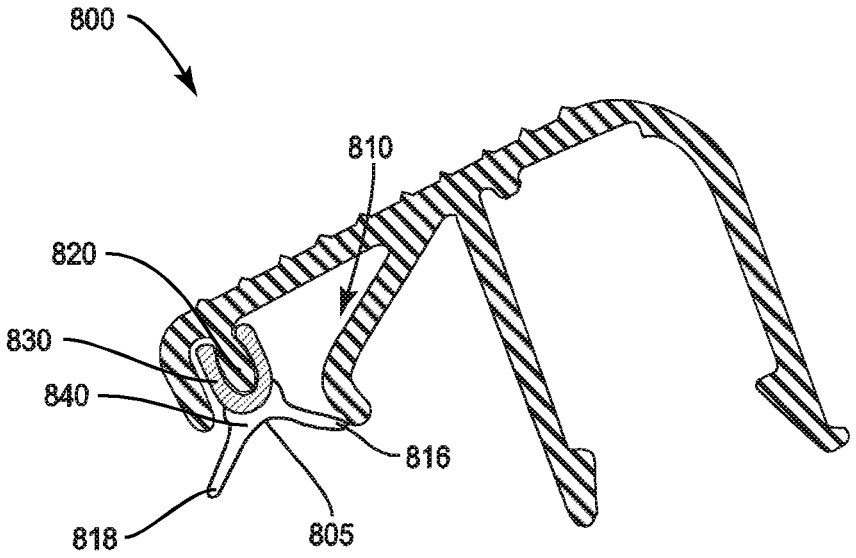
FIG. 13 shows a profile view of a cap according to a second embodiment
Figure 14:
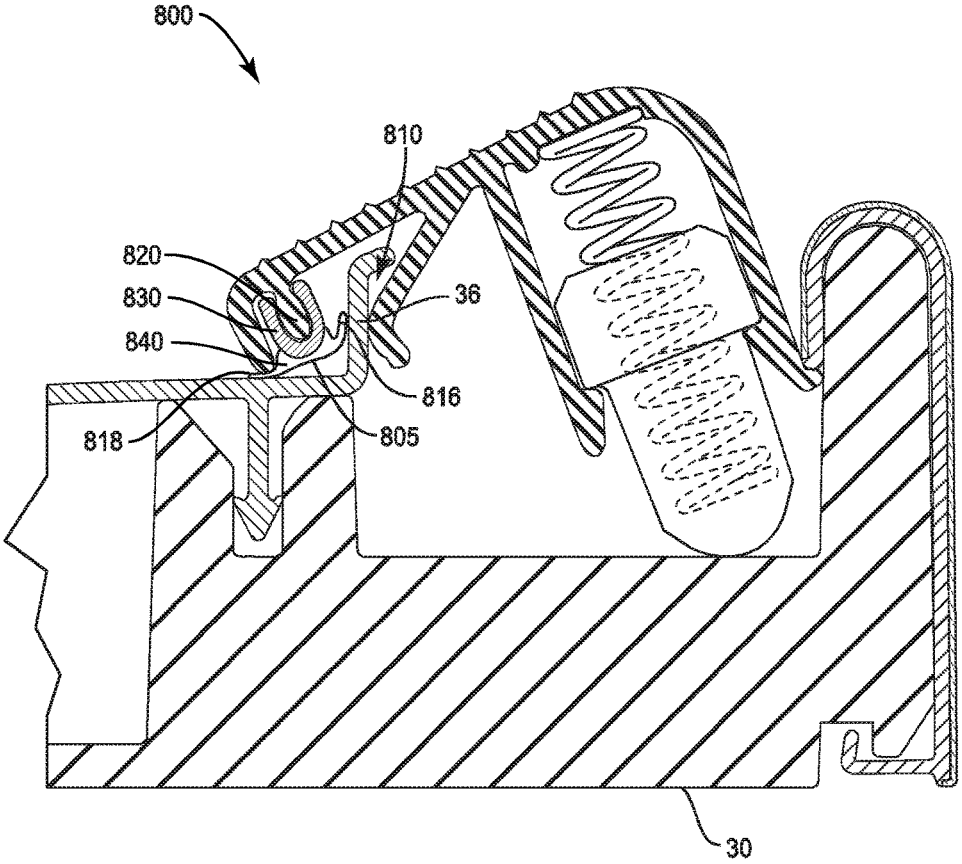
FIG. 14 shows a profile view of the cap according to the second embodiment installed as part of a threshold assembly.

Turning to FIG. 13, an alternative embodiment of a threshold cap 800 is shown. FIG. 14, shows the second threshold cap 800 engaged as part of the threshold assembly 30. The alternative threshold cap 800 is configured to function similarly as the cap 100 of the first embodiment. The alternative cap 800 has many of the same features as the cap 100 as will be appreciated from the foregoing description and at least FIGS. 5-7.

Focus will now be placed on at least some of the potential distinctions between the cap 100 of the first embodiment and the alternative cap 800 shown in FIGS. 13 and 14. First, while the alternative cap 800 may be extruded from resin, similar to the first cap 100, the alternative cap's profile and features may be most advantageous if the alternative cap 800 is made from aluminum or other metal. An aluminum cap 800 can provide higher heat stability when compared to many polymer caps. In the cap 100 of the first embodiment, the body and the sealing fins 116, 118 may be two polymeric materials that are integrally formed with a co-extrusion process. With a metal alternative cap 800, the inventors have realized that achieving a satisfactory bond between metals and resilient materials is difficult. Therefore, to combine the body with a sealing fin assembly 805, a rib 820 is added within a first channel 810. The first channel 810 is configured to be disposed about a dam 36 of the threshold assembly 30 as described above with respect to the cap 100 and shown in FIG. 14. The rib 820 is shaped to form a male portion for joining the sealing fin assembly 805 to the alternative cap 800. In some embodiments, the alternative cap 800 may be constructed from other rigid materials, such as fiber reinforced plastic composites.

The sealing fin assembly 805 will now be further described. The sealing fin assembly 805 can include a clip portion 830 for attachment to the rib 820, and a sealing portion 840. The clip portion 830 may be preferably a rigid polymer base extruded from a heat resistant material. The sealing portion 840 may be preferably a flexible, heat resistant polymer that can be co-extruded with the clip portion 830. The sealing portion 840 may be substantially similar to the first cap 100, including a first and second sealing fin 816, 818. In one embodiment, the sealing fin assembly 805 is symmetric.

Figure 15:
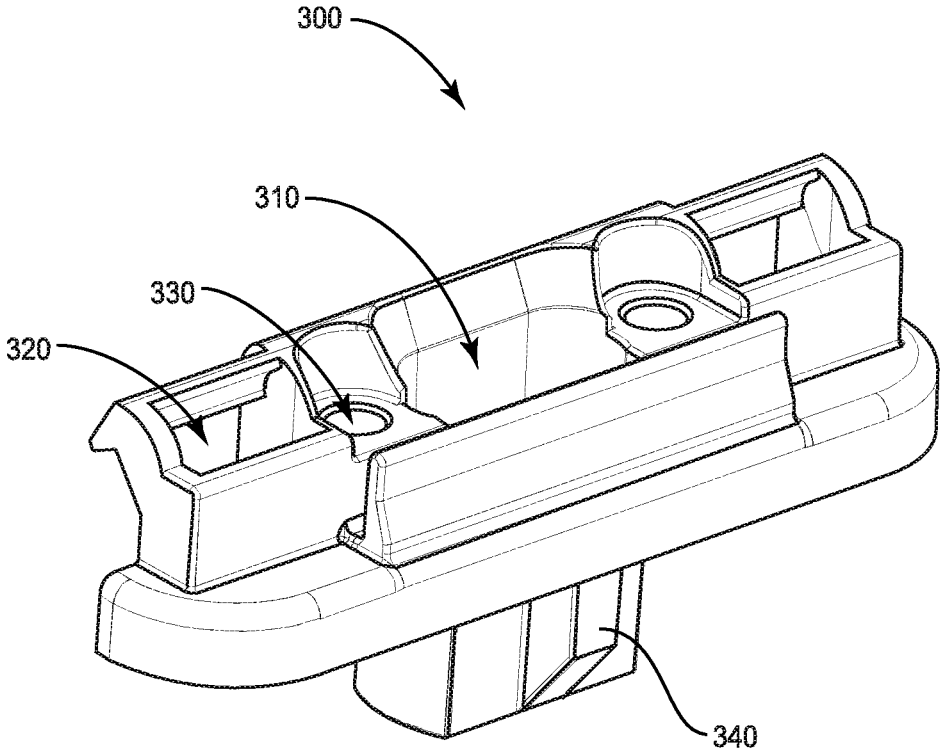
FIG. 15 shows an example pin capture used in embodiments of the present disclosure.

Turning to FIG. 15, embodiments of the pin capture 300 will now be described in more detail. As previously seen in FIG. 4, the pin capture 300 can be substantially positioned within the sill channel 40 and underneath the articulating cap 100. When in-use with the caps 100, 800 of the present disclosure, the bottom of each cap 100, 800 may be notched to allow the cap 100, 800 a full range of motion. Other self-adjusting caps are also available from Endura Products of Colfax, N.C. that are intended to function with the pin capture 300 illustrated by FIG. 15. Particularly, the profile of the pin capture 300 can act as a base for select threshold caps described in U.S. Pat. No. 8,991,100, issued Mar. 31, 2005, which is incorporated herein by reference. When used with the caps from U.S. Pat. No. 8,991,100, the illustrated pin capture 300 may allow full range of motion of those threshold caps without modification to the underside thereof. The profile may also allow the pin capture 300 to support the threshold cap, and to limit travel with a hook portion as described in the '100 patent. Use of either the caps 100, 800 of the present disclosure, or the threshold caps of the '100 patent, with the pin capture 300 requires the aperture 102 through the top of the cap as described above.

The pin capture 300 illustrated in FIG. 15 has several optional advantageous features. First, the blind hole 310 is elongated along the length direction of the threshold assembly 30. This elongation allows for greater tolerances during assembly and installation. Pockets 320 can be provided that can accommodate additional springs or other biasing members to provide additional biasing force to the caps 100, 800 at a central location thereof. Recesses 330 can be provided that lead to openings for anchor screws that allow the pin capture 300 to be securely fastened to the substrate 34. Bosses 340 may be included that extend from the exposed surface of the elongated blind hole 310 so that the pin capture 300 can fit securely within a circular opening formed in the lower surface of the sill channel 40.

The pin capture 300 that is configured to be located completely under the cap 100 provides improvements over prior used arrangements. Previously, a pin receiver could be positioned along a sill channel between two separate threshold caps, one for each door panel 4, 8 of a French door system. Now a single continuous cap 100 may be used under both doors of a similar entryway 1. The use of separate caps sandwiching a prior art pin receiver often required several gaskets or other sealing means to keep water from infiltrating between the joints of the several components. Use of a single cap 100 over the pin capture 300 eliminates much of these sealing concerns. Use of a single cap 100 is also easier to install because the proper length of the cap 100 can be more easily gauged. With two threshold caps, the length of each had to be precisely determined and cut to provide proper sealing and positioning of the pin receiver below the astragal. The pin capture 300 disposed below the cap 100 is now more protected from possible damage because it is no longer exposed to moving door panels or being stepped on by users.

The unique features of the pin capture 300 may be best understood in connection with a threshold assembly 30 described in terms of the following paragraphs:

Paragraph J: A threshold assembly comprising:

a substrate;

a sill deck;

a nosing;

a sill channel at least partially defined by the nosing and the substrate;

a self-adjusting cap system disposed within the sill channel, the cap system including a cap having an aperture through a top wall thereof; and a pin capture disposed within the sill channel, below the cap, and corresponding in location to the aperture.

Figure 16:
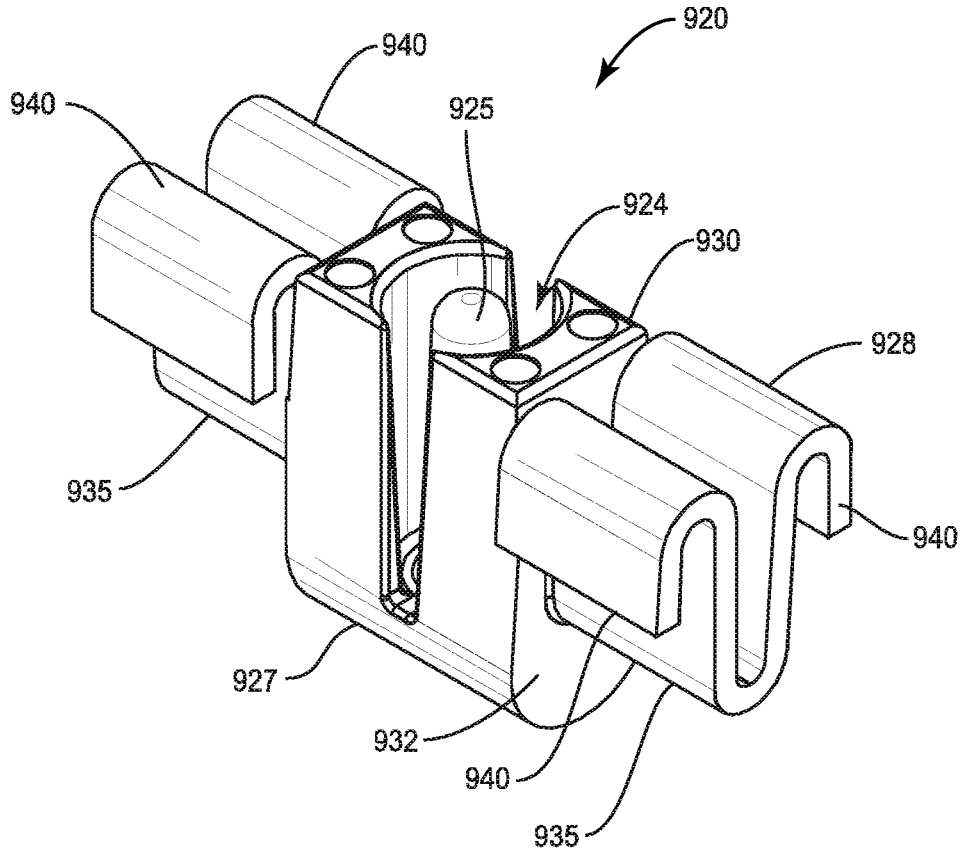
FIG. 16 shows an embodiment of a plunger for use with the present disclosure.

Turning to FIG. 16, a plunger 920 according to an embodiment of the present disclosure is shown. The plunger 920 may include a cavity 924 for positioning a lower end of a spring 210 as seen in FIG. 6. A boss 925 may be disposed within the cavity 924. The boss 925 could extend through the center of a coil spring to help stabilize a coil spring held in the plunger 920. The lower end 927 of the plunger 920 may have a curved shape to allow the plunger 920 to pivot and slide more easily with respect to the lower surface of the sill channel. The plunger 920 may include a central region 930 flanked by a pair of spring clips 935. Each spring clip 935 may be attached to the central region 930. Each spring clip 935 can have one or more resilient arms 940. The plunger 920 can be pressed through the entrance of the second channel 120 of the cap 100. During insertion, the resilient arms 940 of each spring clip 935 may compress toward one another to fit through the entrance into the second channel 120. After passing the retaining fingers 126 (shown in FIG. 5) the resilient arms 940 can expand back outwardly. The expanded resilient arms 940 present a top portion 928 of the plunger 920 that can be wider than a lower portion 932 of the plunger 920. The expanded spring clips 935 can be maintained within the second channel 120 by contact with the abutment surface formed by the retaining fingers 126 when the cap 100 is in the uppermost position. The lower portion 932 of the plunger 920 may then extend from the entrance of the second channel 120, at least when the cap 100 is in the uppermost position. The illustrated embodiment of the plunger 920, which has spring clips 935, may have a design beneficial for insertion through the entrance of the second channel 120. However, the plunger 920 may also be assembled with the cap 100 by sliding the plunder 920 in through an open end of the cap 100.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A threshold comprising:

a substrate;

a tread surface having an interior end and an exterior end;

an upward extending dam adjacent to the interior end of the tread surface;

an upward extending nosing opposite to the upward extending dam;

an upwardly-open sill channel at least partially defined between the upward extending nosing and the upward extending dam;

a threshold cap on the sill channel, the threshold cap having an aperture through a top wall thereof;

a biasing member arranged to bias the top wall of the threshold cap upward, such that the biasing member biases the top wall of the threshold cap during engagement with a door panel or a door sweep; and a pin capture disposed at least partially within the sill channel, below the threshold cap and separate from the top wall, wherein the pin capture is located below the aperture to receive a pin passing through the aperture.

2. The threshold of claim 1, wherein the pin capture comprises a body having a hole configured to accept an astragal bolt pin, wherein an opening to the hole is elongated.

3. The threshold of claim 2, further comprising at least one boss extending from a surface of the hole.

4. The threshold of claim 1, wherein the biasing member is positioned at least partially within the sill channel.

5. The threshold of claim 1, wherein the sill channel has a floor, and a bore extends into the floor, wherein at least a portion of the pin capture is disposed within the bore.

6. The threshold of claim 1, wherein the pin capture is taller than the sill channel.

7. The threshold of claim 1, wherein the threshold cap comprises a notch below the top wall to provide clearance below the threshold cap for the pin capture.

8. The threshold of claim 1, wherein the pin capture comprises at least one pocket configured to retain a biasing member.

9. The threshold of claim 1, wherein the pin capture comprises at least one recess, the recess having an opening in a bottom thereof for anchor screws configured to secure the pin capture to the substrate.

10. An entryway, comprising:

a header;

a first side jamb spaced apart from a second side jamb;

a first door panel hinged to the first side jamb;

a second door panel hinged to the second side jamb; and a threshold assembly, the threshold assembly comprises:

a substrate;

a tread surface having an interior end and an exterior end;

an upward extending dam adjacent to the interior end of the tread surface;

an upward extending nosing opposite to the upward extending dam;

an upwardly-open sill channel at least partially defined between the upward extending nosing and the upward extending dam;

a threshold cap on the sill channel, the threshold cap having an aperture through a top wall thereof;

a biasing member arranged to bias the top wall of the threshold cap upward, such that the biasing member biases the top wall of the threshold cap during engagement with a door panel or a door sweep; and a pin capture disposed at least partially within the sill channel, below the threshold cap and separate from the top wall, wherein the pin capture is located below the aperture to receive a pin passing through the aperture, wherein the threshold cap extends below both the first door panel and the second door panel when the first and second door panels are closed.

11. The entryway of claim 10, wherein the pin capture comprises a body having a hole configured to accept an astragal bolt pin, wherein an opening to the hole is elongated.

12. The entryway of claim 11, further comprising at least one boss extending from a surface of the hole.

13. The entryway of claim 10, wherein the biasing member is positioned at least partially within the sill channel.

14. The entryway of claim 10, wherein the sill channel has a floor, and a bore extends into the floor, wherein at least a portion of the pin capture is disposed within the bore.

15. The entryway of claim 10, wherein the pin capture is taller than the sill channel.

16. The entryway of claim 10, wherein the threshold cap comprises a notch below the top wall to provide clearance below the threshold cap for the pin capture.

17. The entryway of claim 10, wherein the pin capture comprises at least one pocket configured to retain a biasing member.

18. The entryway of claim 10, wherein the pin capture comprises at least one recess, the recess having an opening in a bottom thereof for anchor screws configured to secure the pin capture to the substrate.

19. The threshold of claim 1, wherein the biasing member is disposed below the top wall of the threshold cap.

20. The entryway of claim 10, wherein the biasing member is disposed below the top wall of the threshold cap.

* * * * *